US011459840B2

(12) United States Patent
Nguyen

(10) Patent No.: US 11,459,840 B2
(45) Date of Patent: Oct. 4, 2022

(54) TUBING HANGER RUNNING TOOL SYSTEMS AND METHODS

(71) Applicant: Cameron International Corporation, Houston, TX (US)

(72) Inventor: Dennis P. Nguyen, Pearland, TX (US)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 108 days.

(21) Appl. No.: 16/889,359

(22) Filed: Jun. 1, 2020

(65) Prior Publication Data

US 2021/0017826 A1 Jan. 21, 2021

Related U.S. Application Data

(62) Division of application No. 15/391,501, filed on Dec. 27, 2016, now Pat. No. 10,669,792.

(51) Int. Cl.

| | |
|---|---|
| ***E21B 33/04*** | (2006.01) |
| ***E21B 23/01*** | (2006.01) |
| ***E21B 23/04*** | (2006.01) |
| ***E21B 23/02*** | (2006.01) |

(52) U.S. Cl.

CPC ..... *E21B 23/01* (2013.01); *E21B 23/02* (2013.01); *E21B 23/04* (2013.01); *E21B 33/04* (2013.01); *E21B 33/0415* (2013.01)

(58) Field of Classification Search

CPC ..... E21B 33/04; E21B 33/415

See application file for complete search history.

(56) References Cited

U.S. PATENT DOCUMENTS

| | | | |
|---|---|---|---|
| 3,926,457 | A | 12/1975 | Williams, Jr. et al. |
| 4,736,799 | A | 4/1988 | Ahlstone |
| 4,836,288 | A | 6/1989 | Wester |

(Continued)

FOREIGN PATENT DOCUMENTS

| | | | |
|---|---|---|---|
| EP | 0535277 A1 * | 4/1993 | ..... E21B 33/04 |
| EP | 2518260 | 10/2012 | |
| GB | 2299104 | 9/1996 | |

OTHER PUBLICATIONS

PCT Invitation to Pay Additional Fees for PCT Application No. PCT/US2017/067749 dated Mar. 21, 2018; 15 Pages.

(Continued)

*Primary Examiner* — Giovanna Wright
(74) *Attorney, Agent, or Firm* — Helene Raybaud

(57) ABSTRACT

A hanger running tool configured to set a hanger assembly within a wellhead includes a rotatable tool configured to couple to the hanger assembly via a first threaded interface having a first orientation. The hanger running tool also includes an outer sleeve coupled to the rotatable tool, and the outer sleeve includes one or more slots configured to engage a drive ring coupled to the hanger assembly via a second threaded interface having a second orientation opposite the first orientation. Rotation of the rotatable tool in a first direction is configured to loosen the rotatable tool from the hanger assembly while causing the one or more slots of the outer sleeve to drive the drive ring in the first direction, thereby tightening the drive ring about the hanger assembly and causing the drive ring to drive a lock ring radially-outwardly to engage a corresponding recess of the wellhead.

18 Claims, 16 Drawing Sheets

(56) References Cited

U.S. PATENT DOCUMENTS

| | | | | |
|---|---|---|---|---|
| 5,069,288 | A | 12/1991 | Singeetham | |
| 5,249,629 | A | 10/1993 | Jennings | |
| 5,372,201 | A | 12/1994 | Milberger | |
| 5,456,321 | A * | 10/1995 | Shiach | E21B 33/04 166/382 |
| 6,823,938 | B1 | 11/2004 | Milberger | |
| 7,231,970 | B2 | 6/2007 | Matusek et al. | |
| 8,474,537 | B2 | 7/2013 | Voss et al. | |
| 8,973,653 | B2 | 3/2015 | Thornburrow et al. | |
| 2005/0133216 | A1 | 6/2005 | Bartlett | |
| 2010/0193195 | A1 | 8/2010 | Nguyen et al. | |
| 2011/0005774 | A1 | 1/2011 | Sinnoff et al. | |
| 2012/0305269 | A1* | 12/2012 | Bories | E21B 33/043 166/382 |
| 2014/0166298 | A1 | 6/2014 | Fenwick | |
| 2014/0305631 | A1 | 10/2014 | Schulte et al. | |
| 2015/0136394 | A1 | 5/2015 | Turley et al. | |
| 2015/0252635 | A1 | 9/2015 | Hartley et al. | |
| 2016/0010404 | A1 | 1/2016 | Nguyen et al. | |
| 2016/0032674 | A1 | 2/2016 | Nguyen et al. | |
| 2016/0186502 | A1 | 6/2016 | Nguyen | |
| 2016/0265298 | A1 | 9/2016 | Nguyen | |
| 2017/0226817 | A1 | 8/2017 | Richards et al. | |
| 2018/0179838 | A1 | 6/2018 | Nguyen | |
| 2018/0258725 | A1 | 9/2018 | Levert, Jr. et al. | |

OTHER PUBLICATIONS

PCT International Search Report and Written Opinion; PCT/US2017/067749; dated Jun. 29, 2018; 21 pages.

* cited by examiner

TUBING HANGER RUNNING TOOL SYSTEMS AND METHODS

CROSS-REFERENCE TO RELATED APPLICATION

This application is a divisional of U.S. application Ser. No. 15/391,501, filed on Dec. 27, 2016, and entitled "TUBING HANGER RUNNING TOOL SYSTEMS AND METHODS," which is hereby incorporated by reference in its entirety for all purposes.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Natural resources, such as oil and gas, are used as fuel to power vehicles, heat homes, and generate electricity, in addition to various other uses. Once a desired resource is discovered below the surface of the earth, drilling and production systems are often employed to access and extract the resource. These systems may be located onshore or offshore depending on the location of a desired resource. Further, such systems generally include a wellhead through which the resource is extracted. These wellheads may have wellhead assemblies that include a wide variety of components and/or conduits, such as a tubing string, hangers, valves, fluid conduits, and the like, that facilitate drilling and/or extraction operations. For example, the tubing string may facilitate flow of the natural resource from the formation toward surface production facilities.

In some instances, a tubing hanger may be provided within the wellhead to support the tubing string. In some cases, one tool is utilized to run the tubing hanger into the wellhead, and another tool is utilized to run and set a seal into the wellhead to form a seal (e.g. annular seal) between the tubing hanger and the wellhead. Furthermore, some tools may be passed multiple times into the wellhead to set the tubing hanger and/or to lock the seal in place within the wellhead, thereby resulting in inefficient operations.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Certain embodiments of the present disclosure include systems and methods having a tubing hanger running tool (THRT) configured to run and set a tubing hanger and a seal assembly within a wellhead of a mineral extraction system. In certain embodiments, the THRT is configured to couple to the tubing hanger (e.g., via a retainer ring), and then to lower and set the tubing hanger and the seal assembly within the wellhead by moving (e.g., pushing) the THRT axially downward into the wellhead. In certain embodiments, the THRT includes a piston assembly that is configured to drive a lock ring radially outward into a corresponding recess of the wellhead, which sets (e.g., locks) the tubing hanger in place within the wellhead. In certain embodiments, the piston assembly is configured to energize the seal assembly to seal an annular space between the tubing hanger and the wellhead and to drive a lock ring radially inward into a corresponding recess of the tubing hanger to set (e.g., lock) the seal assembly in place between the tubing hanger and the wellhead. In some embodiments, the THRT is configured to run and to set the tubing hanger and the seal assembly without rotational movement of any component of the THRT relative to the wellhead. As set forth above, some existing tools may rotate relative to the wellhead to set seal assemblies in a desired position within the wellhead. The presently disclosed embodiments enable efficient running and setting of the tubing hanger and the seal assembly via one trip of the THRT and via axial movement of the THRT, as well as provide reduced wear on certain wellhead components (e.g., the tubing spool, or the like). Furthermore, certain embodiments of the present disclosure include an adapter that may be utilized with various tools, such as the THRT, and certain embodiments of the present disclosure include a rotatable tubing hanger running tool (RTHRT) having rotatable components that enable the RTHRT to efficiently set the tubing hanger within the wellhead.

Figure 1:
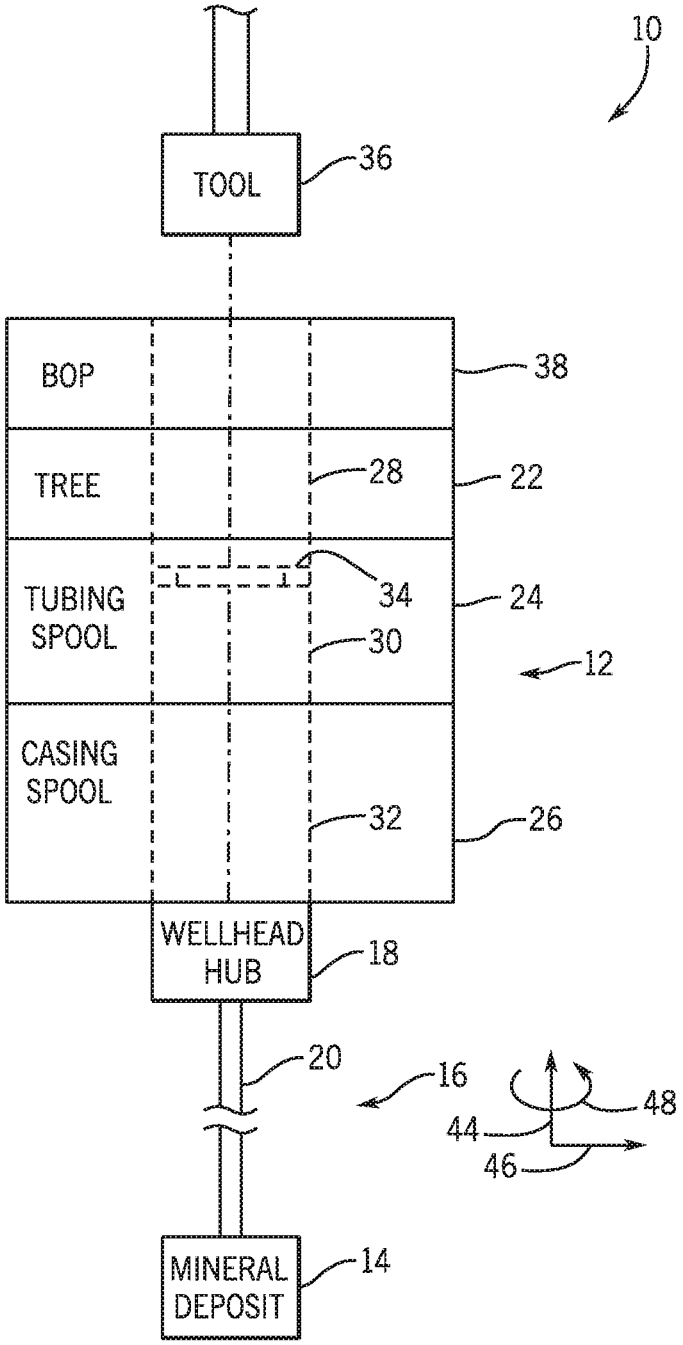
FIG. 1 is a block diagram of a mineral extraction system in accordance with an embodiment of the present disclosure.

FIG. 1 is a block diagram of an embodiment of a mineral extraction system 10. The illustrated mineral extraction system 10 may be configured to extract various minerals and natural resources, including hydrocarbons (e.g., oil and/or natural gas), from the earth, or to inject substances into the earth. As illustrated, the system 10 includes a wellhead 12 coupled to a mineral deposit 14 via a well 16. The well 16 may include a wellhead hub 18 and a well bore 20. The wellhead hub 18 generally includes a large diameter hub disposed at the termination of the well bore 20 and configured to connect the wellhead 12 to the well 16. As will be appreciated, the well bore 20 may contain elevated pressures. For example, the well bore 20 may include pressures that exceed 10,000, 15,000, or even 20,000 pounds per square inch (psi). Accordingly, the mineral extraction system 10 may employ various mechanisms, such as seals, plugs, and valves, to control and regulate the well 16. For example, plugs and valves are employed to regulate the flow and pressures of fluids in various bores and channels throughout the mineral extraction system 10.

In the illustrated embodiment, the mineral extraction system 10 includes a tree 22, a tubing spool 24, a casing spool 26, and a blowout preventer (BOP) 38. The tree 22 generally includes a variety of flow paths (e.g., bores), valves, fittings, and controls for operating the well 16. For instance, the tree 22 may include a frame that is disposed about a tree body, a flow-loop, actuators, and valves. Further, the tree 22 may provide fluid communication with the well 16. For example, the tree 22 includes a tree bore 28 that provides for completion and workover procedures, such as the insertion of tools into the well 16, the injection of various chemicals into the well 16, and so forth. Further, minerals extracted from the well 16 (e.g., oil and natural gas) may be regulated and routed via the tree 22. For instance, the tree 22 may be coupled to a flowline that is tied back to other components, such as a manifold. Accordingly, produced minerals flow from the well 16 to the manifold via the wellhead 12 and/or the tree 22 before being routed to shipping or storage facilities.

As shown, the tubing spool 24 may provide a base for the tree 22 and includes a tubing spool bore 30 that connects (e.g., enables fluid communication between) the tree bore 28 and the well 16. As shown, the casing spool 26 may be positioned between the tubing spool 24 and the wellhead hub 18 and includes a casing spool bore 32 that connects (e.g., enables fluid communication between) the tree bore 28 and the well 16. Thus, the tubing spool bore 30 and the casing spool bore 32 may provide access to the well bore 20 for various completion and workover procedures. The BOP 38 may consist of a variety of valves, fittings, and controls to prevent oil, gas, or other fluid from exiting the well in the event of an unintentional release of pressure or an overpressure condition.

As shown, a tubing hanger 34 is positioned within the tubing spool 24. The tubing hanger 34 may be configured to support tubing (e.g., production tubing) that is suspended in the well bore 20 and/or to provide a path for control lines, hydraulic control fluid, chemical injections, and so forth. As discussed in more detail below, one or more seal assemblies may be positioned between the tubing hanger 34 and the tubing spool 24. In the illustrated embodiment, the system 10 includes a tool 36, such as a tubing hanger running tool (THRT) or a rotatable tubing hanger running tool (RTHRT). The tool 36 may be configured to be lowered (e.g., run) toward the wellhead 12 (e.g., via a crane or other supporting device). To facilitate discussion, the mineral extraction system 10, and the components therein, may be described with reference to an axial axis or direction 44, a radial axis or direction 46, and a circumferential axis or direction 48.

Figure 2:
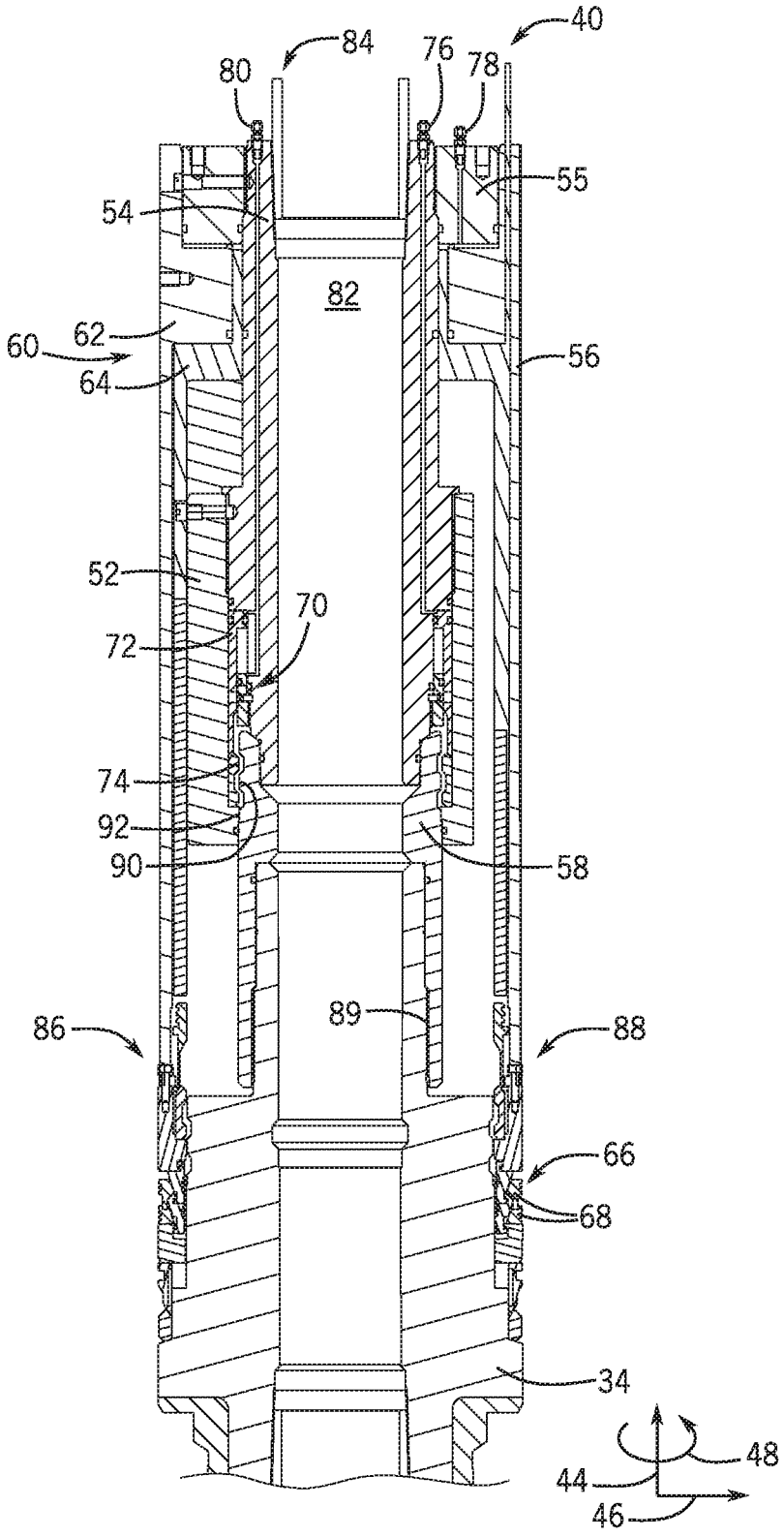
FIG. 2 is a cross-section of an embodiment of a tubing hanger running tool (THRT) that may be utilized to run a tubing hanger into a wellhead of the mineral extraction system of FIG. 1.

FIG. 2 is a cross-section of an embodiment of a THRT 40 that may be utilized to run the tubing hanger 34 into the wellhead 12 of the mineral extraction system 10 of FIG. 1. As shown, the THRT 40 includes an outer body 52 (e.g., annular body), an inner body 54 (e.g., annular body), a seal ring 55 (e.g., annular seal ring), a piston assembly 60 (e.g., annular piston assembly) having an outer piston 62 (e.g., annular piston or outer sleeve) and an inner piston 64 (e.g., annular piston or inner sleeve), a seal assembly 66 (e.g., annular seal assembly) having one or more seals 68 (e.g., annular seals, such as metal annular seals), a retainer-engaging assembly 70 having a push ring 72 (e.g., annular push ring) and a retainer lock ring 74 (e.g., segmented ring or c-shaped ring), one or more first ports 76 (e.g., fluid port), one or more second ports 78, one or more third ports 80, and a central bore 82 that extends from a first end 84 (e.g., proximal end) to a second end 86 (e.g., distal end) of the THRT 40.

As shown, the THRT 40 may enable one or more control lines 56 to extend axially across the THRT 40. For example, the one or more control lines 56 may extend axially through one or more openings formed in the outer body 52, the inner body 54, the outer piston 62, and/or the inner piston 64. In the illustrated embodiment, the seal assembly 60 is suspended from and/or supported by the outer piston 62 via an interface 88 (e.g., a j-slot interface, a key-slot interface, a friction fit, or the like). In the illustrated embodiment, a retainer ring 58 (e.g., annular retainer ring) is coupled (e.g., threadably coupled) to the tubing hanger 34 (e.g., via a threaded interface 89). In operation, the retainer ring 58 may be coupled to the tubing hanger 34, and then the THRT 40 may be positioned about the retainer ring 58. For example, the THRT 40 may be moved along the axial axis 44 relative to the retainer ring 58 until a portion of the retainer ring 58 is positioned between the inner body 54 and the outer body 52 along the radial axis 46 and/or until the retainer lock ring 74 of the THRT 40 is aligned with a corresponding groove 90 (e.g., annular groove) formed in a radially-outer wall 92 (e.g., annular wall) of the retainer ring 58.

Figure 3:
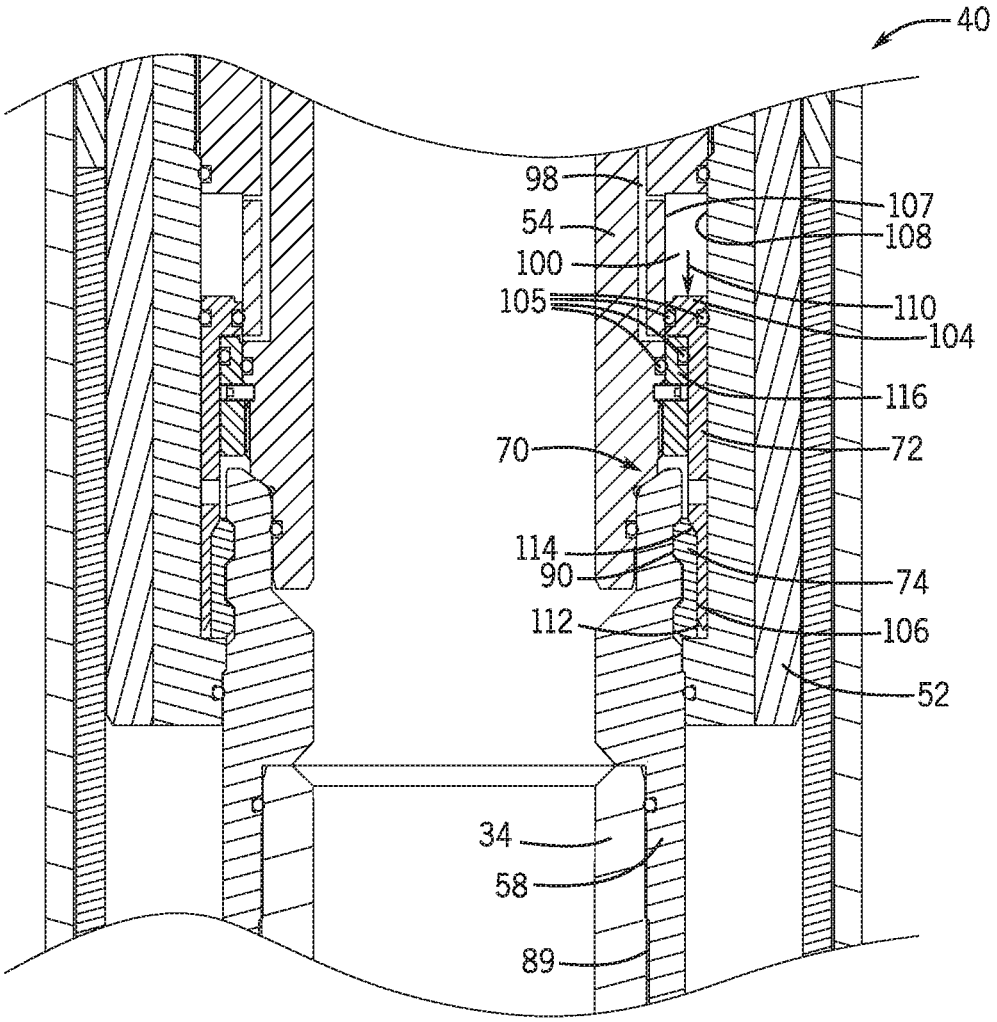
FIG. 3 is a cross-section of a portion of the THRT of FIG. 2 coupled to a retainer ring.
Figure 3:
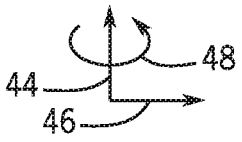

FIG. 3 is a cross-section of a portion of the THRT 40 coupled to the retainer ring 58. In operation, once the retainer lock ring 74 of the THRT 40 is aligned with the corresponding groove 90 of the retainer ring 58 along the axial axis 44, fluid may be provided via the one or more first ports 76 through one or more corresponding passageways 98 to a space 100 (e.g., annular space). As shown in FIG. 1, the one or more first ports 76 are positioned at the first end 84 of the THRT 40, and as shown in FIG. 2, the passageways 98 are formed in the inner body 54 of the THRT 40, and the space 100 is defined between the outer body 52 and the inner body 54 of the THRT 40 along the radial axis 46. In the illustrated embodiment, the retainer-engaging assembly 70 includes the push ring 72 having a first end 104 (e.g., proximal end) that is positioned within the space 100 and a second end 106 (e.g., distal end) that is positioned adjacent to the retainer lock ring 74. As shown, the push ring 72 may extend between and seal against (e.g., via annular or o-ring seals 105) a radially-outer wall 107 (e.g., annular wall) of the inner body 54 and a radially-inner wall 108 (e.g., annular wall) of the outer body 52 of the THRT 40.

When the fluid is provided from the one or more first ports 78 through the corresponding one or more passageways 98 to the space 100, the fluid drives the push ring 72 in the axial direction 110 relative to the outer body 52, as well as relative to the inner body 54, the retainer ring 58, and the retainer lock ring 74 from the position shown in FIG. 2 to the position shown in FIG. 3. As the push ring 72 moves, as shown by arrow 110, a tapered inner surface 112 (e.g., tapered annular surface or conical surface) of the push ring 72 moves along a corresponding tapered outer surface 114 (e.g., tapered annular surface or conical surface) of the retainer lock ring 74 and the second end 106 of the push ring 72 moves to a position between the retainer lock ring 74 and the outer body 52 along the radial axis 46, thereby driving the retainer lock ring 74 radially inwardly to engage the corresponding grooves 90 of the retainer ring 58. Thus, the THRT 40 may be coupled to the retainer ring 58 and the tubing hanger 34 (e.g., at the drill floor), and the THRT 40 may then be used to lower the tubing hanger 34 into the wellhead 12.

The retainer lock ring 74 may have any suitable configuration for radially collapsing to couple the THRT 40 to the tubing hanger 34. For example, in some embodiments, the retainer lock ring 74 is a c-shaped ring having a first circumferential end and a second circumferential end that define a space (e.g., a gap) at a circumferential location about the ring. Such a configuration enables radial collapse of the retainer lock ring 74 into the corresponding grooves 90, as a distance between the first end and the second end across the space decreases in response to the axially downward movement of the push ring 72. As shown, in some embodiments, one or more support rings 116 (e.g., annular rings) supporting one or more additional annular or o-ring seals 105 may be coupled to the inner body 54 to facilitate assembly of the THRT 40, block fluid flow out of the space 100, or the like.

Figure 4:
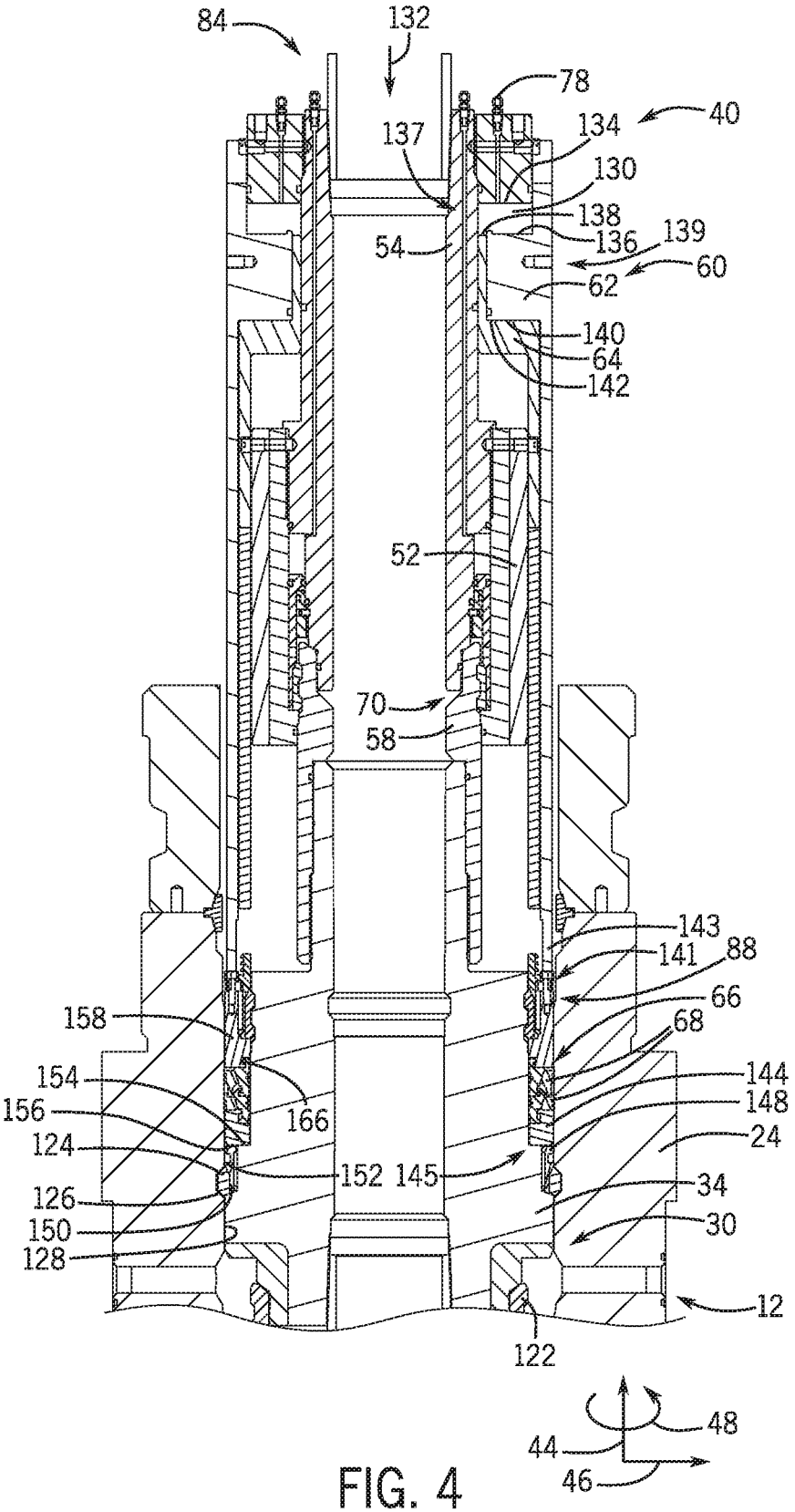
FIG. 4 is a cross-section of the THRT of FIG. 2 and the tubing hanger, wherein the tubing hanger is in a locked position within the wellhead.

FIG. 4 is a cross-section of the THRT 40 and the tubing hanger 34 in a locked position 120 within the bore 30 of the tubing spool 24. As shown, the THRT 40 and the tubing hanger 34 are coupled to one another via the retainer ring 58 and the retainer-engaging assembly 70. In particular, the retainer ring 58 is threadably coupled to the tubing hanger 34 via the threaded interface 89, and the retainer ring 58 is coupled to the THRT 40 via engagement between the retainer lock ring 74 of the THRT 40 and the corresponding groove 90 of the retainer ring 58. Together, the THRT 40, the retainer ring 58, and the tubing hanger 34 may be lowered into the wellhead until the tubing hanger 34 reaches a landed position in which the tubing hanger 34 may contact and be supported by a shoulder 122 (e.g., radially-inwardly extending surface and/or axially-facing surface) of another component within the wellhead 12, such as the tubing spool 24, another hanger, or the like. In the landed position, a lock ring 124 (e.g., segmented lock ring or c-shaped lock ring or hanger-to-wellhead lock ring) that is coupled to the tubing hanger 34 may be aligned with a corresponding groove 126 (e.g., annular groove or circumferentially-extending groove) formed in a radially-inner surface 128 of the tubing spool 24 along the axial axis 44.

In operation, once the THRT 40 and the tubing hanger 34 reach the landed position 120 within the bore 30 of the tubing spool 24, fluid may be provided via the one or more second ports 78 into a space 130 (e.g., annular space). As shown, the one or more second ports 78 are positioned at the first end 84 of the THRT 40 and extend axially through the seal ring 55 of the THRT 40, and the space 130 is defined between the inner body 54 and the outer piston 62 of the THRT 40 along the radial axis 46, as well as between an axially-facing surface 134 (e.g., annular surface) of the seal ring 55 and opposed axially-facing surfaces 136, 138 (e.g., annular surfaces) at respective first ends 137, 139 (e.g., proximal ends) of the outer piston 62 and the inner piston 64 along the axial axis 44.

When the fluid is provided from the one or more second ports 78 to the space 130, the fluid exerts a force on the axially-facing surfaces 136, 138 and drives axial movement of the outer piston 62 and the inner piston 64 of the piston assembly 60 within the space 130, as shown by arrow 132. Thus, the outer piston 62 and the inner piston 64 move axially relative to the outer body 52 and the inner body 54, as well as relative to the tubing spool 24 and the tubing hanger 34. In some embodiments, during an initial portion of the seal installation process, the outer piston 62 and the inner piston 64 may move together, due at least in part to the difference in surface area of the axially-facing surface 136, 138. For example, the axially-facing surface 136 of the outer piston 62 is larger than the axially-facing surface 138 of the inner piston 64 (e.g., at least 10, 20, 30, 40, 50, 60, 70, 80, or 90 percent larger), and thus, the force exerted on the axially-facing surface 136 of the outer piston 62 is larger than the force exerted on the axially-facing surface 138 of the inner piston 64. Accordingly, during the initial portion of the seal installation process, the inner piston 64 may be driven axially, as shown by arrow 132, due primarily to the force exerted on the axially-facing surface 136 of the outer piston 62 and the contact between respective lower axially-facing surfaces 140, 142 of the outer piston 62 and the inner piston 64.

As shown, a first axial end 141 (e.g., proximal end) of the seal assembly 66 having the one or more seals 68 is coupled to a second axial end 143 (e.g., distal end) of the outer piston 62 via the interface 88. In operation, the outer piston 62 may move axially until the tubing hanger 34 reaches the locked position 130 in which the lock ring 124 engages the corresponding grooves 126 to block movement (e.g., axial movement) of the tubing hanger 34 relative to the tubing spool 24. In some embodiments, the axial movement of the outer piston 62 may cause the tubing hanger 34 to reach the locked position 130. For example, in some embodiments, axial movement of the outer piston 62 may cause a portion of the seal assembly 66, such as a support element 144 (e.g., support ring) at a second axial end 145 (e.g., distal end) of the seal assembly 66, to contact and to drive a drive ring 148 (e.g., annular drive ring) axially until the drive ring 148 drives the lock ring 124 radially outwardly to engage the corresponding groove 126 formed in the radially-inner surface 128 of the tubing spool 24, thereby locking the tubing hanger 34 within the tubing spool 24. As shown, the drive ring 148 and the lock ring 124 may have corresponding tapered surfaces 150, 152 (e.g., opposed tapered annular surfaces or conical surfaces) to facilitate axial movement of the drive ring 148 relative to the lock ring 124 and to enable the drive ring 148 to drive and to hold the lock ring 124 within the corresponding groove 126. Furthermore, as shown, the drive ring 148 and the support element 144 of the seal assembly 66 may include opposed axially-facing surfaces 154, 156 to enable the support element 144 to drive the drive ring 148 along the axial axis 44. Additionally, the axial movement of the outer piston 62 compresses and/or energizes the one or more seals 68 between the support element 144 and an energizing ring 158 (e.g., annular energizing ring) of the seal assembly 66.

Figure 5:
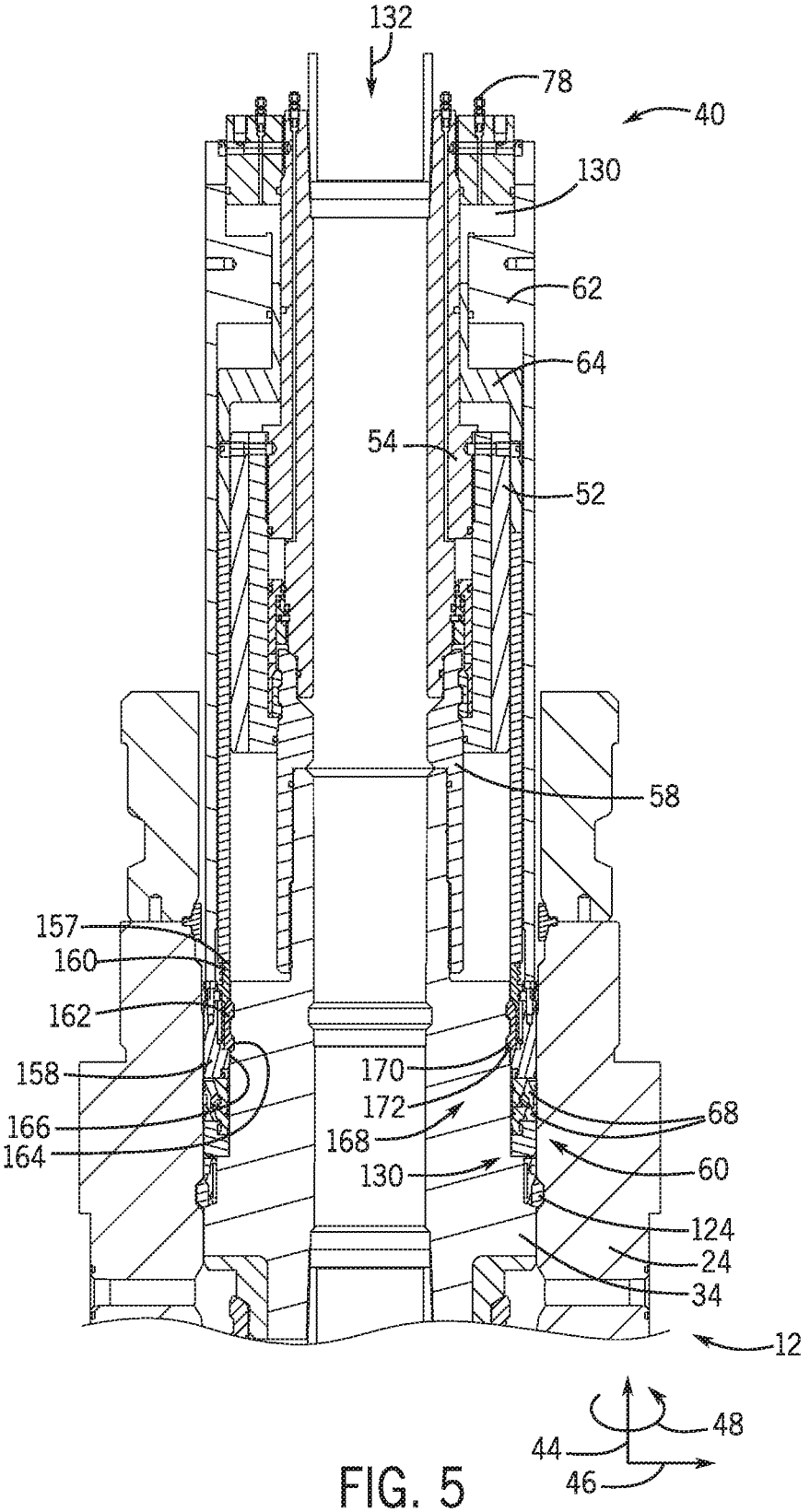
FIG. 5 is a cross-section of the THRT of FIG. 2 and the tubing hanger, wherein a seal assembly is set in an annular space between the tubing hanger and the wellhead.

FIG. 5 is a cross-section of the THRT 40 and the tubing hanger 34, wherein the seal assembly 66 is set (e.g., energized and locked) in an annular space between the tubing hanger 34 and the tubing spool 24. Once the tubing hanger 34 reaches the locked position 130 and the one or more seals 68 are energized, the outer piston 62 may be blocked from moving in the direction of arrow 132 (e.g., due to the contact between various structures positioned axially between the lock ring 124 and the outer piston 62). In operation, additional fluid may be provided to the space 130 via the one or more second ports 78 to drive the inner piston 64 relative to the outer piston 62, as well as relative to other structures, such as the outer body 52, the inner body 54, the tubing hanger 34, and the tubing spool 24, for example. As the inner piston 64 moves in the axial direction of arrow 132, a second axial end 157 (e.g., distal end) of the inner piston 64 may contact and drive a drive ring 160 (e.g., annular drive ring) axially, which in turn drives a lock ring 162 (e.g., segmented lock ring or c-shaped lock ring or seal-to-casing lock ring) radially-inwardly to engage a corresponding recess 164 formed in a radially-outer wall 166 (e.g., annular wall) of the tubing hanger 34, thereby locking the seal assembly 66 in place between the tubing hanger 34 and the tubing spool 24. As shown, the lock ring 162 is positioned axially above the energizing ring 158, and an interface 168 between opposed surfaces 170, 172 (e.g., axially-facing surfaces) of the lock ring 162 and the energizing ring 158 maintains the tubing hanger 34 in the illustrated locked position 130 and the one or more seals 68 in the illustrated energized position.

The lock ring 124 may have any suitable configuration for radially expanding to couple the tubing hanger 34 to the tubing spool 24. Furthermore, the lock ring 162 may have any suitable configuration for radially collapsing to couple the seal assembly 66 to the tubing hanger 34. For example, in some embodiments, the lock ring 124 and/or the lock ring 162 are a c-shaped ring having a first circumferential end and a second circumferential end that define a space (e.g., a gap) at a circumferential location about the ring. Such a configuration enables radial movement (e.g., expansion or collapse) of the lock ring 124, 162 as a distance between the first end and the second end across the space changes (e.g., increases or decreases) in response to the axially downward movement of the respective drive ring 148, 160.

Figure 6:
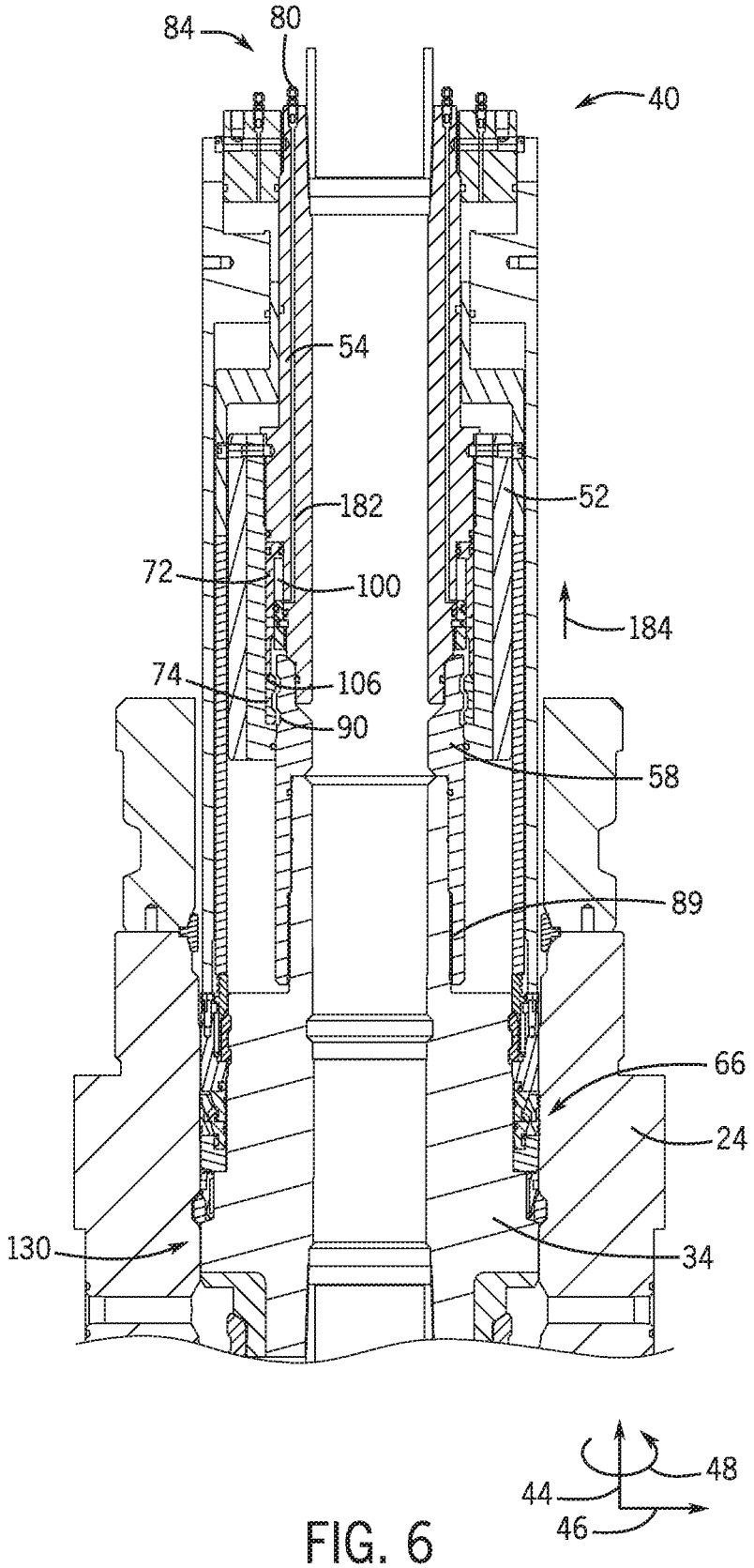
FIG. 6 is a cross-section of the THRT of FIG. 2 disengaged from the retainer ring and the tubing hanger that is in the locked position within the wellhead.

FIG. 6 is a cross-section of the THRT 40 disengaged from the retainer ring 58, which is coupled to the tubing hanger 34 (e.g., via the threaded interface 89) that is in the locked position 130 within the bore 30 of the tubing spool 24. In operation, after the tubing hanger 34 is locked within the tubing spool 24 and the seal assembly 66 is set (e.g., energized and locked) between the tubing hanger 34 and the tubing spool 24, the THRT 40 may be disengaged from the retainer ring 58. In some embodiments, the THRT 40 may be disengaged from the retainer ring 58 by providing fluid via the one or more third ports 80 through one or more corresponding passageways 182 to the space 100 (e.g., annular space). As shown, the one or more third ports 80 are positioned at the first end 84 of the THRT 40, and the passageways 182 are formed in the inner body 54 of the THRT 40.

When the fluid is provided from the one or more third ports 80 through the corresponding one or more passageways 182 to the space 100, the fluid drives the push ring 72 axially relative to the outer body 52, as well as relative to the inner body 54 and the retainer lock ring 74, from the position shown in FIG. 5 to the position shown in FIG. 6. As the push ring 72 moves, as shown by arrow 184, the second end 106 of the push ring 72 may move to a position that is axially above the retainer lock ring 74 (e.g., the second end 106 may be withdrawn from the position between the outer body 52 and the retainer lock ring 72 along the radial axis 46), thereby enabling the retainer lock ring 74 to move radially outwardly to disengage from the corresponding groove 90 of the tubing hanger 34. As noted above, the retainer lock ring 74 may be a segmented ring or a c-shaped ring that is biased toward the illustrated expanded (e.g., radially-expanded) position. In this manner, the THRT 40 may be separated from the retainer ring 58 and the tubing hanger 34 to enable withdrawal of the THRT 40 from the wellhead 12.

Figure 7:
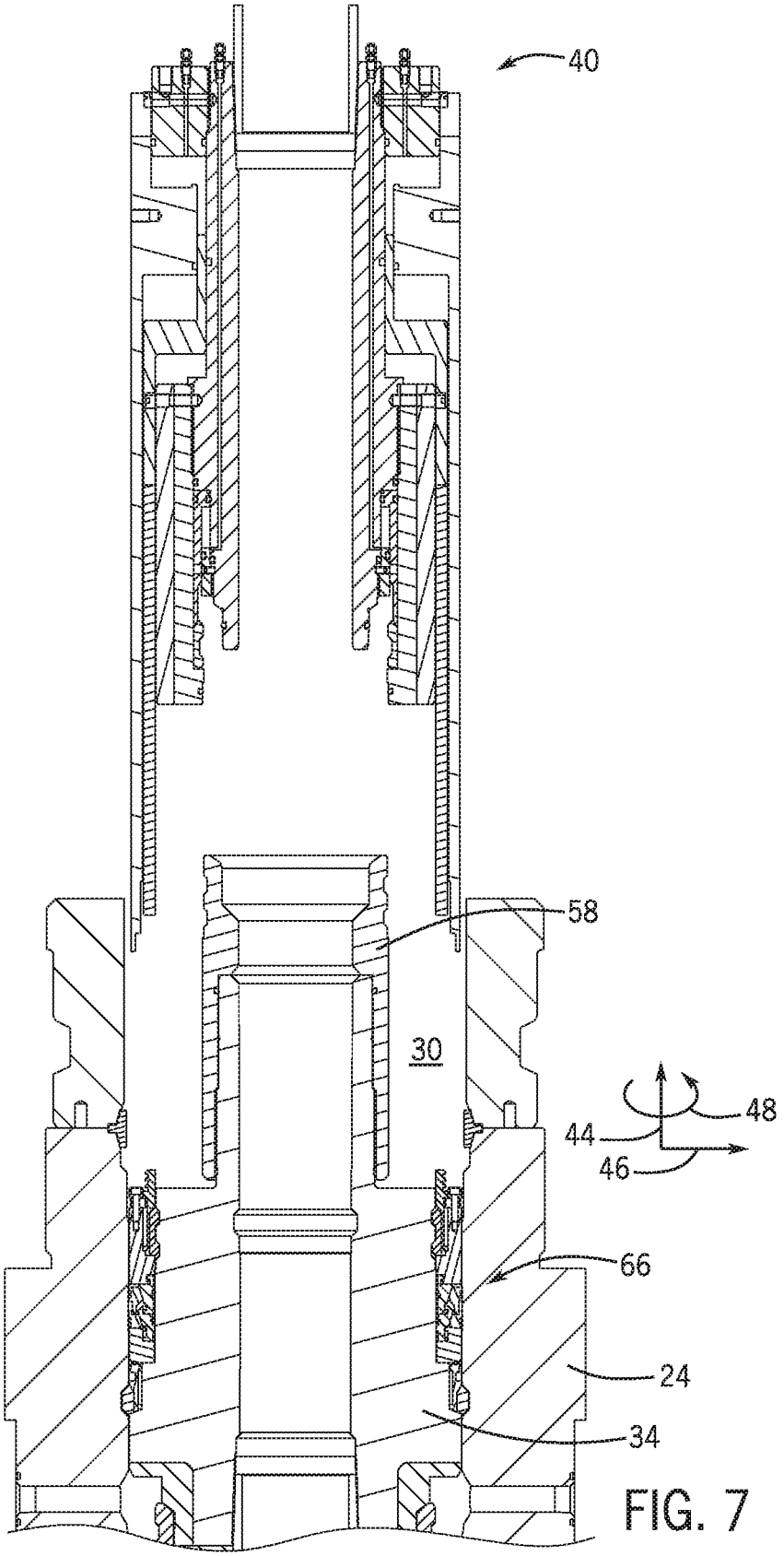
FIG. 7 is a cross-section of the THRT of FIG. 2 separated from the seal assembly that is set in the annular space between the tubing hanger and the wellhead.

FIG. 7 is a cross-section of the THRT 40 separated from the seal assembly 66, which is set (e.g., energized and locked) within the bore 32 of the tubing spool 24. Once the THRT 40 is disengaged from the retainer ring 58, the THRT 40 may be separated from the seal assembly 66, such as by disengaging the outer piston 62 of the THRT 40 from the seal assembly 66 (e.g., by rotating the outer piston 62, such as by a quarter turn, to disengage a pin of the outer piston 62 from a j-slot formed in the seal assembly 66). Once the THRT 40 is separated from the seal assembly 66, the THRT 40 may be withdrawn from the wellhead 12 by moving (e.g., pulling) the THRT 40 in the axial direction 44 (e.g., without rotating the THRT 40 relative to the wellhead 12).

After the THRT 40 is withdrawn from the wellhead 12, the seal assembly 66, the tubing hanger 34, and the retainer ring 58 may remain within the wellhead 12. In operation, once the tubing hanger 34 and the seal assembly 66 are installed within the wellhead 12, a back pressure valve may be installed within the bore 30 to control bore pressure, then the BOP 38 (shown in FIG. 1) may be removed from the wellhead 12, and then the retainer ring 58 may be separated from the tubing hanger 34 (e.g., via rotation of the retainer ring 58 relative to the tubing hanger 34) and withdrawn from the wellhead 12. In some embodiments, the control lines 56 may be tested (e.g., to ensure that they are functioning properly) and/or then various components, such as the tree 22 (e.g., shown in FIG. 1), may be installed above the tubing spool 24 once the retainer ring 58 is withdrawn from the wellhead 12.

Figure 8:
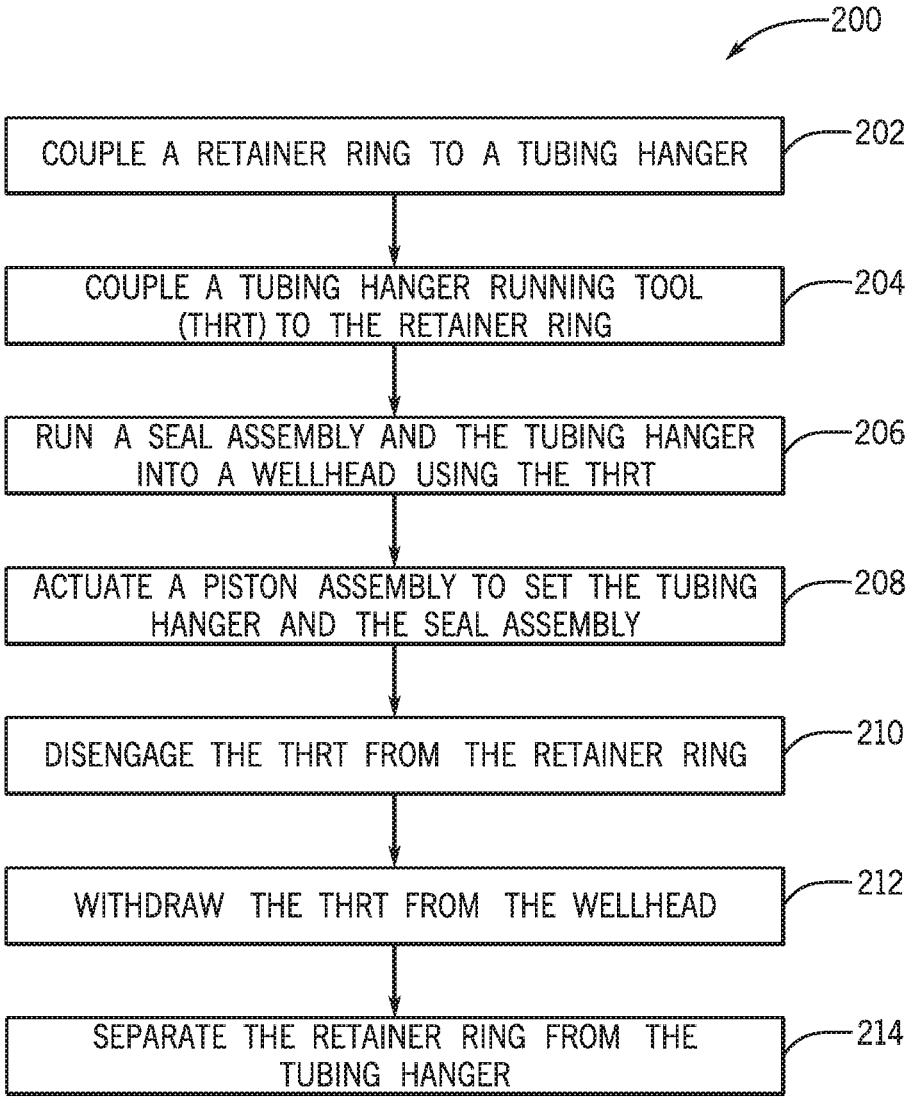
FIG. 8 is a flow diagram of an embodiment of a method for running, locking, and sealing a tubing hanger within a wellhead using a THRT.

FIG. 8 is a flow diagram of an embodiment of a method 200 for running, setting, and locking the tubing hanger 34 and the seal assembly 66 within the wellhead 12 using the THRT 40. The method 200 includes various steps represented by blocks. It should be noted that some or all of the steps of the method 200 may be performed as an automated procedure by an automated system and/or some or all of the steps of the method 200 may be performed manually by an operator. Although the flow chart illustrates the steps in a certain sequence, it should be understood that the steps may be performed in any suitable order and certain steps may be carried out simultaneously, where appropriate. Further, certain steps or portions of the method 200 may be omitted and other steps may be added.

The method 200 may begin by coupling the retainer ring 58 to the tubing hanger 34, in step 202. As discussed above, the retainer ring 58 may be coupled to the tubing hanger 34 via the threaded interface 89. In step 204, the THRT 40 may be coupled to the retainer ring 58, such as by providing fluid via the one or more first ports 76 to the space 100 to drive the push ring 72, as shown by arrow 110 in FIG. 3, thereby driving the retainer lock ring 74 radially-inward to engage the corresponding groove 90 of the retaining ring 58.

In step 206, the THRT 40, with the seal assembly 66 and the tubing hanger 34 attached thereto, may be lowered into the wellhead 12. As discussed above, the THRT 40 may run the seal assembly 66 and the tubing hanger 34 into the wellhead 12 until the tubing hanger 34 reaches the landed position. In step 208, the piston assembly 60 may be actuated to set the tubing hanger 34 and the seal assembly 66 within the wellhead 12. As discussed above, once the tubing hanger 34 reaches the landed position, fluid may be provided via one or more second ports 78 to the space 130 to drive the outer piston 62 and the inner piston 64, as shown by arrow 132 in FIGS. 4 and 5. The movement of the outer piston 62 and the inner piston 64 may drive the lock ring 124 into the corresponding groove 126, thereby locking the tubing hanger 34 to the tubing spool 24. The movement of the outer piston 62 may also energize the seal assembly 66, thereby sealing the annular space between the tubing hanger 34 and the tubing spool 24. Additional fluid into the space 130 may drive the inner piston 64, thereby driving the lock ring 162 radially-inward to engage the corresponding recess 164 in the tubing hanger 34 to lock the seal assembly 66 in place within the annular space between the tubing hanger 34 and the tubing spool 24. Thus, the tubing hanger 34 and the seal assembly 66 may be run and set via a hydraulic drive system (e.g., the ports 76, 78, the push ring 72, the piston assembly 60, etc.) in a single trip and without rotation of the THRT 40 relative to the wellhead 12.

In step 210, the THRT 40 may disengage from the retainer ring 58. As discussed above, fluid may be provided via the one or more third ports 80 through one or more corresponding passageways 182 to the space 100 to cause the THRT 40 to disengage from the retainer ring 58. In particular, the fluid may drive the push ring 72 in the direction of arrow 184 shown in FIG. 5, thereby enabling the retainer lock ring 74 to move radially outwardly to disengage from the corresponding groove 90 of the retainer ring 58. In step 212, the THRT 40 may separate from the seal assembly 66 and may be withdrawn from the wellhead 12, while the tubing hanger 34 and the seal assembly 66 remain in the locked position 130 within the wellhead 12. As discussed above, in some embodiments, the THRT 40 may be separated from the seal assembly 66 by disengaging the outer piston 62 of the THRT 40 from the seal assembly 66 (e.g., by rotating the outer piston 62, such as by a quarter turn, to disengage a pin of the outer piston 62 from a j-slot formed in the seal assembly 66).

In step 214, the retainer ring 58 may be separated from the tubing hanger 34, such as by rotating the retainer ring 58 relative to the tubing hanger 34. In some embodiments, once the tubing hanger 34 and the seal assembly 66 are installed within the wellhead 12, a back pressure valve may be installed within the bore 30 to control bore pressure, then the BOP 38 may be removed from the wellhead 12, and then the retainer ring 58 may be separated from the tubing hanger 34 and withdrawn from the wellhead 12. In some embodiments, the control lines 56 may be tested (e.g., to ensure that they are functioning properly) and/or then various components, such as the tree 22, may be installed above the tubing spool 24 once the retainer ring 58 is withdrawn from the wellhead 12 to facilitate production processes.

While the embodiments illustrated in FIGS. 1-8 illustrate the lock ring 124 and the drive ring 148 coupled to the tubing hanger 34, it should be understood that the lock ring 124 and the drive ring 148 may be coupled to the seal assembly 66 (e.g., the distal end 145 of the seal assembly 66), and thus, may be coupled to the THRT 40 in FIG. 2 and may be lowered with the seal assembly 66 relative to the retainer ring 58 and the tubing hanger 34 during assembly at the rig floor, for example.

Figure 9:
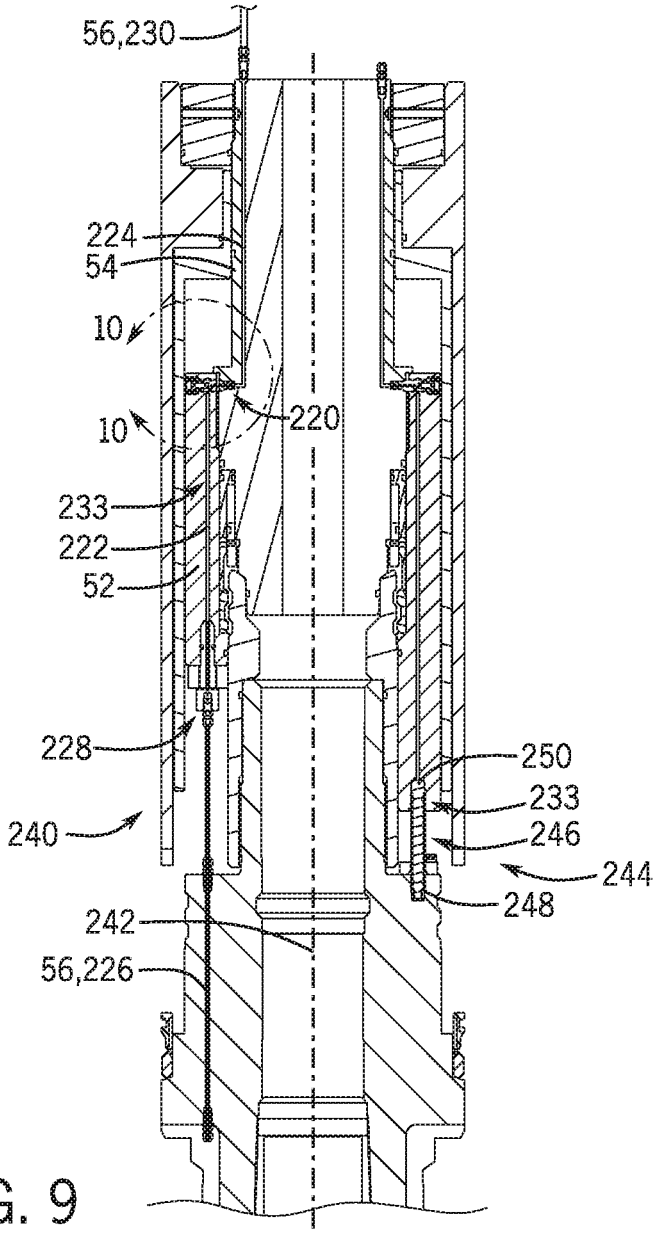
FIG. 9 is a cross-section of an embodiment of a THRT having an adapter.

FIG. 9 is a cross-section of the THRT 40 having an adapter 220 (e.g., a control line adapter). The adapter 220 may be configured to fluidly couple one passageway to another passageway, such as a first passageway 222 formed in the outer body 52 of the THRT 40 to a second passageway 224 formed in the inner body 54 of the THRT 40. In the illustrated embodiment, a first portion 226 of the control line 56 terminates at a control line seal sub 228 (e.g., control line termination assembly) proximate to the second end 86 of the THRT 40, and a second portion 230 of the control line 56 may connect or continue from a connector 232 at the first end 84 of the THRT 40. Thus, a continuous control line path 233 (e.g., a sealed continuous path) is formed between the first portion 226 of the control line 56 and the second portion 230 of the control line 56 through the THRT 40 by the first passageway 222, the adapter 220, and the second passageway 224. The continuous control line path 233 may enable or support fluid flow (e.g., hydraulic control fluid), for example.

To facilitate discussion, a left side 240 of a central axis 242 of FIG. 9 illustrates the control line seal sub 228, and a right side 244 of the central axis 242 of FIG. 9 illustrates a stab-in connector 246 that may be additionally or alternatively be used in the THRT 40. For example, the first portion 226 of the control line 56 may terminate at the stab-in connector 246 having a first end 248 (e.g., distal end) within the tubing hanger 34 and a second end 250 (e.g., proximal end) within the outer body 52 of the THRT 40 to provide the continuous control line path 233.

It should be understood that multiple control lines 56 (e.g., 2, 3, 4, 5, 6, 7, 8, 9, 10, or more) may extend axially through the THRT 40 at discrete locations about the circumference of the THRT 40, and accordingly, multiple adapters 220 (e.g., 2, 3, 4, 5, 6, 7, 8, 9, 10, or more) may be positioned circumferentially about the THRT 40 to accommodate and provide the continuous control line path 233 for each control line 56. As shown, multiple adapters 220 (e.g., 2, 3, 4, 5, 6, 7, 8, 9, 10, or more) may be provided at one position along the axial axis 44, thereby enabling compact construction of the THRT 40.

Figure 10:
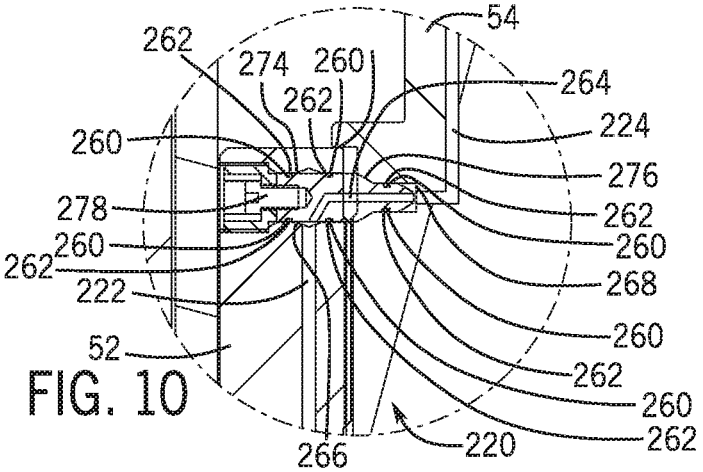
FIG. 10 is a cross-section of the adapter of FIG. 9 taken within line 10-10.

FIG. 10 is a cross-section of the adapter 220 taken within line 10-10 of FIG. 9. As shown, the adapter 220 may include seal grooves 260 configured to support seals 262 (e.g., annular seals, such as o-ring seals) to isolate fluid within the adapter 220 and to provide the continuous control line path 233. In the illustrated embodiment, the adapter 220 includes an adapter channel 264 that extends from a side wall 266 (e.g., annular wall) of the adapter 220 to a radially-inner end 268 of the adapter 220, and the adapter 220 couples an axially-extending portion 270 of the first passageway 222 to a radially-extending portion 272 of the second passageway 224. However, the adapter channel 264 may have any configuration to fluidly couple the first passageway 222 to the second passageway 224. As shown, the adapter 220 is positioned within a first recess 274 formed in the outer body 52 and a second recess 276 formed in the inner body 54, and the adapter 220 is fastened to the outer body 52 via a fastener 278 (e.g., threaded fastener, such as a bolt). The adapter 220 in FIGS. 9 and 10 may be utilized to provide the continuous control line path 233 during certain steps of the method 200 of FIG. 8.

Figure 11:
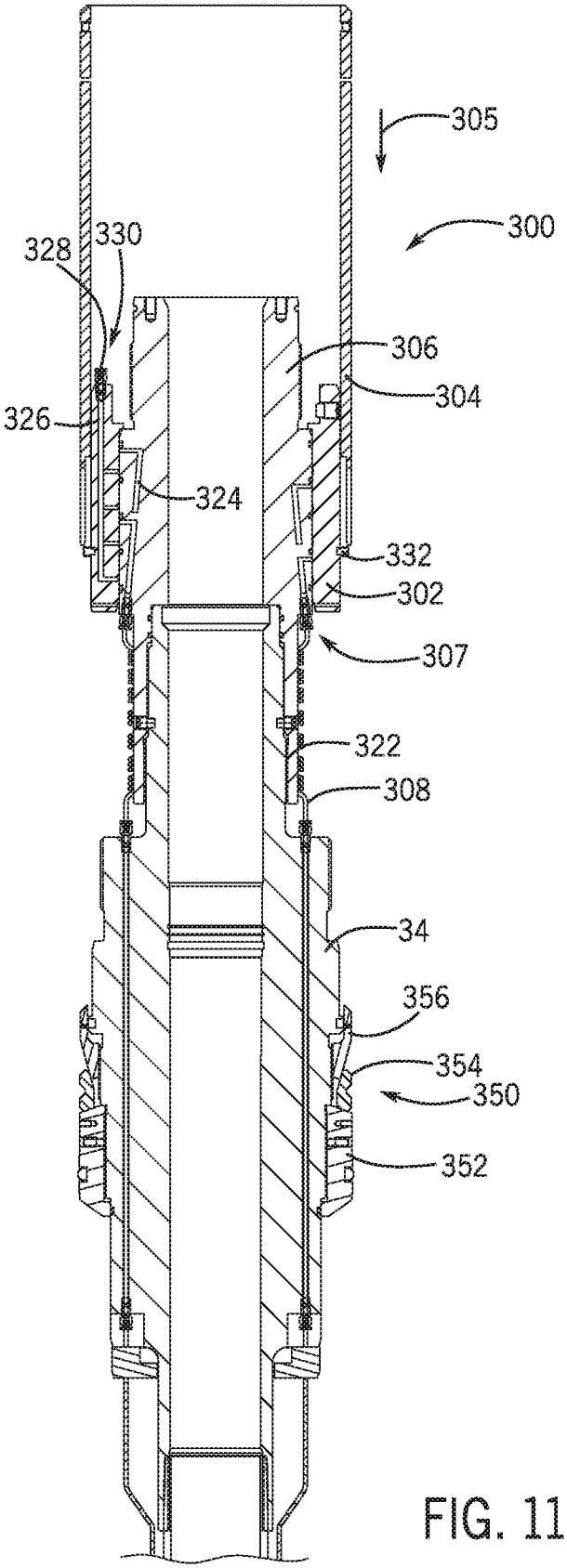
FIG. 11 is a cross-section of a portion of a rotatable tubing hanger running tool (RTHRT) that may be utilized to run a tubing hanger into a wellhead of the mineral extraction system of FIG. 1.
Figure 12:
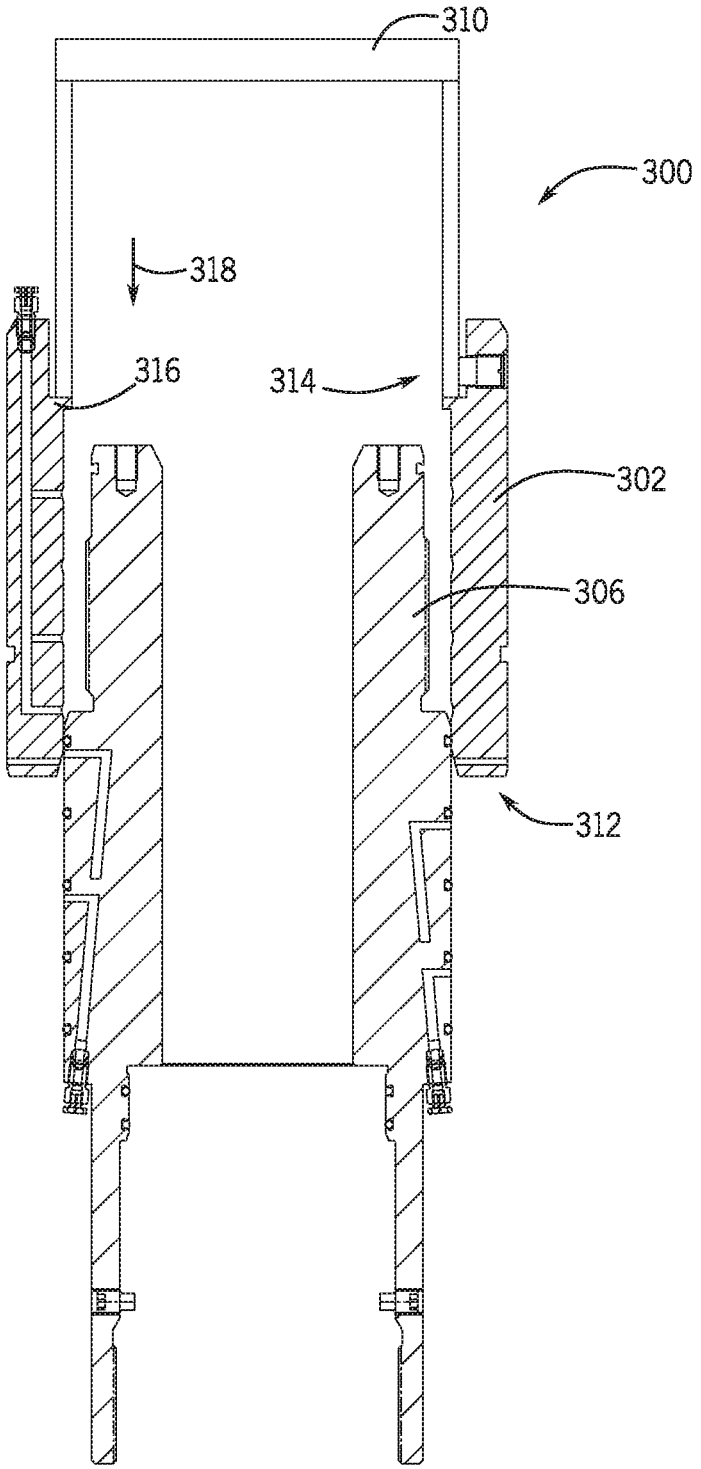
FIG. 12 is a cross-section illustrating a setting tool that may be used to drive a seal sleeve of the RTHRT of FIG. 11.
Figure 13:
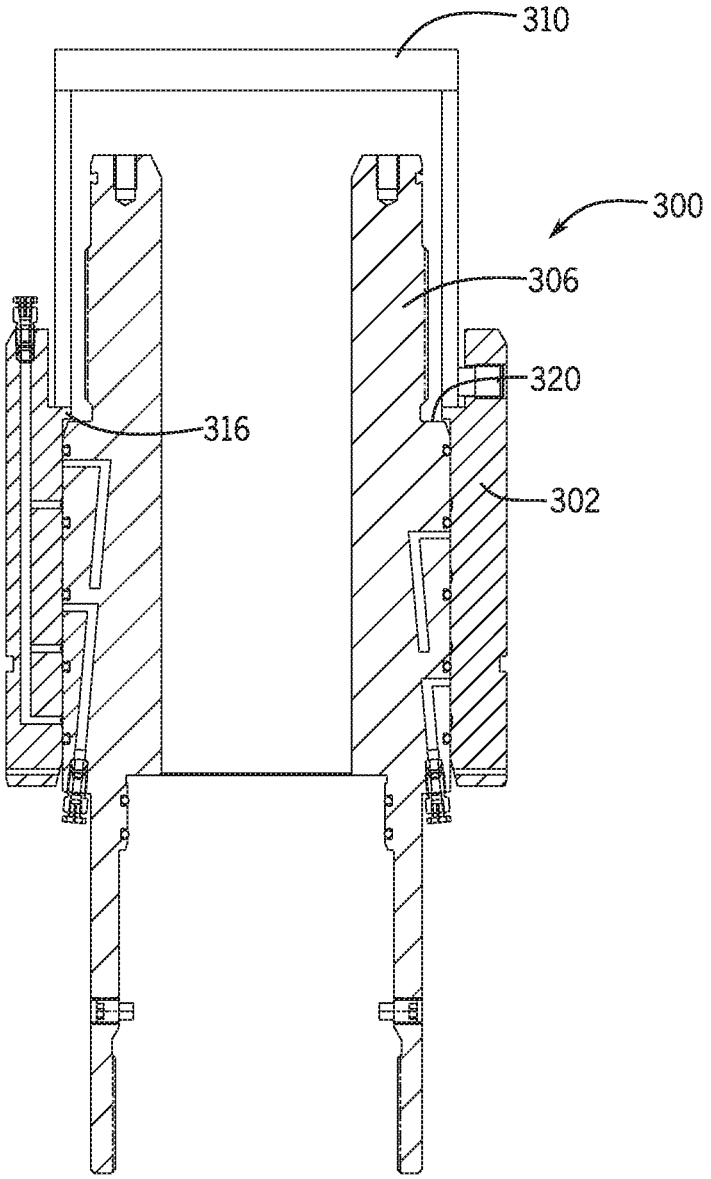
FIG. 13 is a cross-section illustrating the seal sleeve of FIG. 12 positioned about a control line seal sub.

FIG. 11 is a cross-section of a portion of a rotatable tubing hanger running tool (RTHRT) 300 that may be utilized to run and set the tubing hanger 34 within the wellhead 12. As shown, the RTHRT 300 includes a seal sleeve 302 (e.g., annular seal sleeve or retainer ring) and a torque sleeve 304 (e.g., annular torque sleeve or outer sleeve). The seal sleeve 302 may be positioned about a control line seal sub 306 (e.g., annular seal sub) that is configured to support control lines 308. To assemble the RTHRT 300, the seal sleeve 302 may be driven axially, such as via a setting tool 310 (e.g., annular setting tool) shown in FIGS. 12 and 13. For example, with reference to FIG. 12, the seal sleeve 302 may be positioned in a first position such that one end 312 (e.g., a distal end) of the seal sleeve 302 circumferentially surrounds at least a portion of the control line seal sub 306. The setting tool 310 may be positioned such that one end 314 (e.g., a distal end) of the setting tool 310 contacts a portion of the seal sleeve 302, such as a radially-inwardly extending protrusion 316 (e.g., annular protrusion or surface) of the seal sleeve 302. The setting tool 310 may be driven axially, as shown by arrow 318 (e.g., without rotation), thereby exerting a force on the seal sleeve 302 and driving the seal sleeve 302 axially to a second position in which the seal sleeve 302 circumferentially surrounds a greater portion of the control line seal sub 306 and/or the protrusion 316 contacts a shoulder 320 (e.g., annular shoulder or annular axially-facing surface) of the control line seal sub 306, as shown in FIG. 13. In this manner, the seal sleeve 302 may be coupled to the control line seal sub 306, such as via a friction fit or interference fit, for example.

Returning to FIG. 11, once the seal sleeve 302 is in the second position about the control line seal sub 306, the control line seal sub 306 may be positioned about and/or coupled to a portion of the tubing hanger 34. Together, the control line seal sub 306 and the tubing hanger 34 may form a tubing hanger assembly 307. In some embodiments, the control line seal sub 306 may be threadably coupled to the tubing hanger 34, such as via a threaded interface 322. In the illustrated embodiment, the control lines 308 are circumferentially wrapped about the control line seal sub 306 and are fluidly coupled to passageways 324 in the control line seal sub 306 and passageways 326 in the seal sleeve 302 to enable fluid flow between the control lines 308 at the tubing hanger 34 and a port 328 at another end 330 (e.g., a proximal end) of the seal sleeve 302.

As shown in FIG. 11, the torque sleeve 304 may be positioned about the seal sleeve 302. For example, the torque sleeve 304 may be driven axially, as shown by arrow 305 (e.g., without rotation) into an illustrated first position to circumferentially surround at least a portion of the seal sleeve 302. In some embodiments, the torque sleeve 304 may be blocked from further axial movement and/or may be maintained in the illustrated first position via one or more shear pins 332, for example. In some embodiments, a lock assembly 350 having a lock-supporting ring 352 (e.g., annular ring), a lock ring 354 (e.g., a segmented ring or a c-shaped ring), and a drive ring 356 (e.g., annular ring) is coupled to the tubing hanger 34. As discussed in more detail below, the RTHRT 300 is configured to actuate the lock assembly 350 to lock the tubing hanger 34 within the wellhead 12. In some embodiments, the tubing hanger 34, the control line seal sub 306, the seal sleeve 302, and the torque sleeve 304 may be coupled to one another at the drill floor and/or prior to running or lowering the tubing hanger 34 into the wellhead 12.

Figure 14:
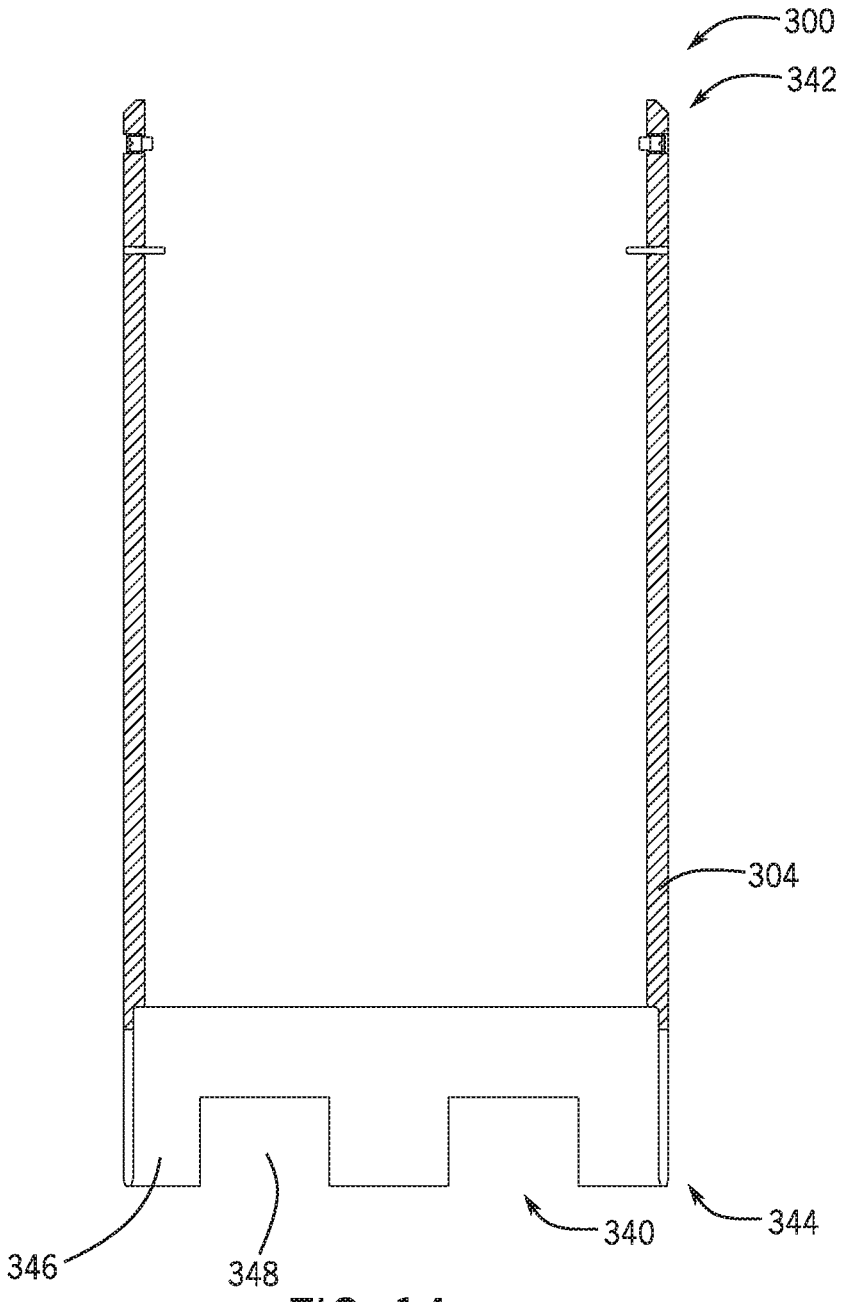
FIG. 14 is a cross-section illustrating slots of a torque sleeve of the RTHRT of FIG. 11.

FIG. 14 is a cross-section illustrating slots 340 (e.g., teeth) of the torque sleeve 304 of the RTHRT 300. As shown, the torque sleeve 304 extends from a first end 342 (e.g., proximal end) to a second end 344 (e.g., distal end), and the slots 340 are positioned at the second end 344 of the torque sleeve 304. In the illustrated embodiment, the slots 340 include multiple extensions 346 and multiple recesses 348 positioned in an alternating manner circumferentially about the torque sleeve 304. As discussed in more detail below, the recesses 348 may be configured to receive corresponding portions of the drive ring 356 of the lock assembly 350 coupled to the tubing hanger 34, and the extensions 346 may be configured to contact and engage the drive ring 356 to cause rotation of the drive ring 356 to lock the tubing hanger 34 within the wellhead 12. Furthermore, as discussed in more detail below, the illustrated configuration may enable the torque sleeve 304 to move axially relative to the drive ring 356 as the torque sleeve 304 drives rotation of the drive ring 356. It should be understood that the illustrated slots 340 are merely exemplary, and the slots 340 may have any of a variety of configurations that enable the torque sleeve 304 to move axially relative to the drive ring 356 as the torque sleeve 304 drives rotation of the drive ring 356.

Figure 15:
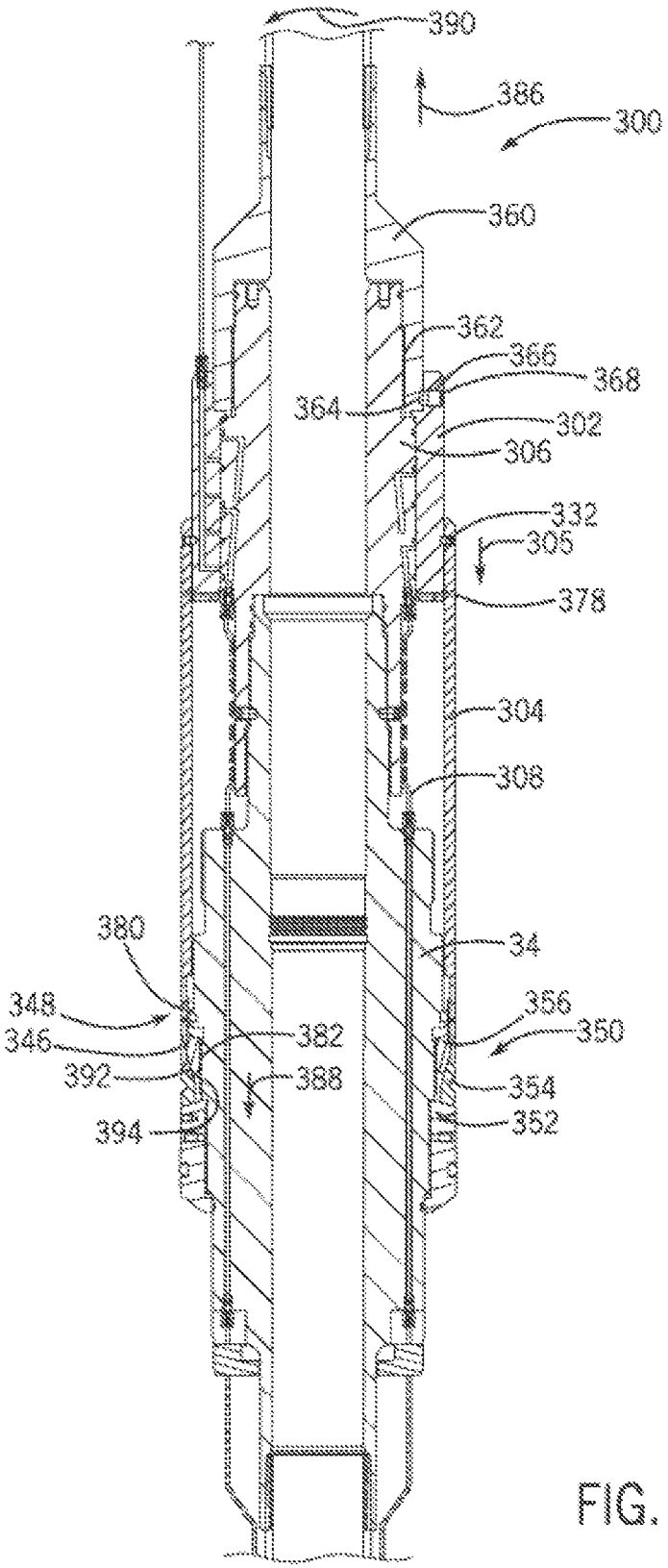
FIG. 15 is a cross-section of the RTHRT of FIG. 11 with a body of the RTHRT coupled to a seal sleeve of the RTHRT.

FIG. 15 is a cross-section of the RTHRT 300 with a body 360 (e.g., annular body or rotatable tool) of the RTHRT 300 coupled to the seal sleeve 302 of the RTHRT 300. To reach the illustrated position, the body 360 may be rotated relative to the control line seal sub 306 to couple the body 360 and the control line seal sub 306 to one another via a threaded interface 362. The body 360 may be rotated until the body 360 is fully threaded onto the control line seal sub 306 and/or until a recess 364 in the body 360 is aligned (e.g., axially and circumferentially aligned) with an opening 366 in the seal sleeve 302. Once aligned, a fastener 368 (e.g., threaded fastener or retainer screw) may be inserted through the opening 366 and into the recess 364 to fasten the body 360 to the seal sleeve 302. The fastener 368 may be configured to block movement of the body 360 relative to the seal sleeve 302. Thus, once fastened to one another with the fastener 368, rotation of the body 360 may drive rotation of the seal sleeve 302. While one fastener 368 is shown to facilitate discussion, it should be understood that multiple fasteners 368 (e.g., 2, 3, 4, or more) may be positioned at various locations about the circumference of the RTHRT 300.

In FIG. 15, the torque sleeve 304 is in a second position in which the torque sleeve 304 engages the drive ring 356 of the lock assembly 350. To reach the second position, the torque sleeve 304 may be driven axially, as shown by arrow 305 (e.g., without rotation), until the recesses 348 receive corresponding portions 380 (e.g., axially-extending extensions) of the drive ring 356 and the extensions 346 are positioned between adjacent corresponding portions 380 (e.g., along the circumferential axis 48). To reach the illustrated position in which the slots 340 engage the drive ring 356, the one or more shear pins 332 may shear (e.g., break). Furthermore, once the torque sleeve 304 engages the drive ring 356, the torque sleeve 304 may be coupled to the seal sleeve 302, such as via one or more fasteners 378 (e.g., threaded fasteners or retainer screws), thereby blocking movement of the seal sleeve 302 relative to the torque sleeve 304. Thus, once fastened to one another with the fastener 378, rotation of the seal sleeve 302 may drive rotation of the torque sleeve 304.

As shown, the drive ring 356 may be threadably coupled to the tubing hanger 34 via a threaded interface 382. The threads at the threaded interface 362 between the body 360 and the control line seal sub 306 may be oriented in a first direction (e.g., left-hand thread or right-hand thread), and the threads at the threaded interface 382 between the drive ring 35 and the tubing hanger 34 maybe oriented in a second direction (e.g., left-hand thread or right-hand thread) that is opposite the first direction. For example, rotation of the body 360 in a first direction (e.g., as shown by arrow 390) to loosen the body 360 from the control line seal sub 306 drives the attached seal sleeve 302 and the attached torque sleeve 304 to rotate in the first direction, and the slots 340 of the torque sleeve 304 (e.g., the extensions 346) contact and drive rotation of the drive ring 356 in the first direction, thereby tightening the drive ring 356 about the tubing hanger 34. Thus, rotation of the body 360 in the first direction causes the body 360 and the attached seal sleeve 302 and the torque sleeve 304 to move in a first direction along the axial axis 44, as shown by arrow 386, and also drives the drive ring 356 in a second, opposite direction along the axial axis 44, as shown by arrow 388.

Figure 16:
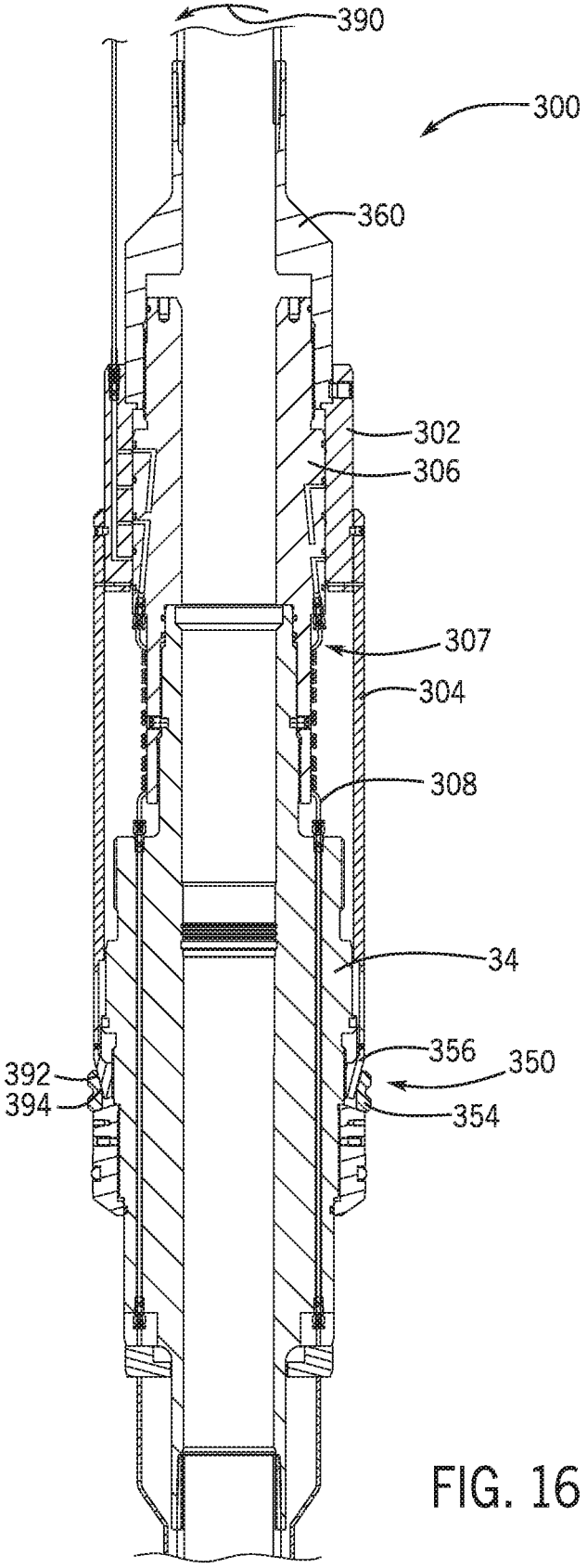
FIG. 16 is a cross-section of the RTHRT of FIG. 11 as the RTHRT drives the tubing hanger into a locked position within the wellhead.

With the foregoing in mind, FIG. 16 is a cross-section of the RTHRT 300 as the RTHRT 300 drives the tubing hanger 34 into a locked position within the wellhead 12. In the locked position, the lock ring 354 protrudes radially-outwardly from the tubing hanger 34 to engage a corresponding recess of the wellhead 12. As shown, the drive ring 356 includes a tapered outer surface 392 (e.g., tapered annular surface, conical surface, or radially-outer surface) and the lock ring 354 includes a corresponding tapered outer surface 394 (e.g., tapered annular surface, conical surface, or radially-inner surface) to facilitate axial movement of the drive ring 356 relative to the lock ring 354 and to enable the drive ring 356 to drive (e.g., wedge against) the lock ring 354 radially-outwardly to engage the corresponding recess in the wellhead 12, thereby locking the tubing hanger 34 within the wellhead 12. As shown in the progression between FIGS. 15 and 16, due to the rotation 390, the body 360, the seal sleeve 302, the torque sleeve 304 move axially relative to the tubing hanger 34, control line seal sub 306, and the lock assembly 350. Further rotation of the body 360 may enable complete separation of the body 360, the seal sleeve 302, and the torque sleeve 304 from the tubing hanger 34, control line seal sub 306, and the lock assembly 350. Thereafter, the body 360, the seal sleeve 302, and the torque sleeve 304 may be withdrawn from the wellhead 12, while the tubing hanger 34 having the control line seal sub 306 attached thereto may remain in the locked position (e.g., via the lock assembly 350) within the wellhead 12. To facilitate discussion, the body 360 is shown as rotating in the direction 390; however, it should be understood that the body 360 may be configured to loosen via rotation in a rotational direction opposite to the direction 390.

Figure 17:
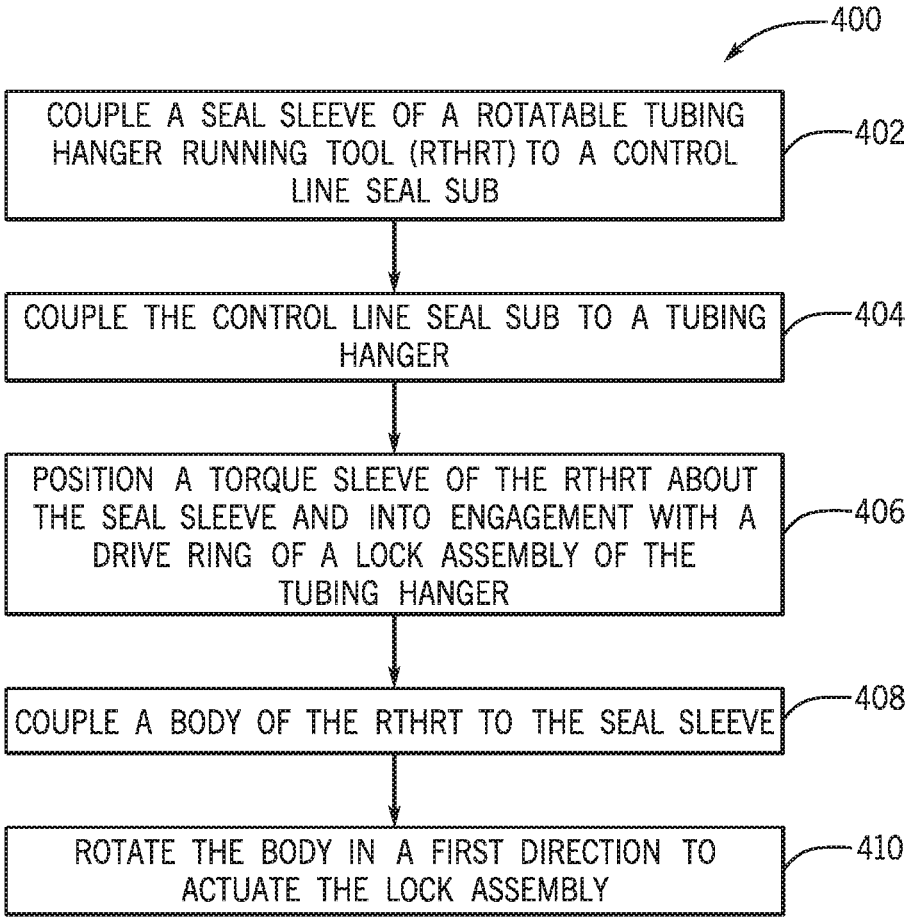
FIG. 17 a flow diagram of an embodiment of a method for running and locking a tubing hanger within a wellhead using a RTHRT.

FIG. 17 a flow diagram of an embodiment of a method 400 for running, setting, and locking the tubing hanger 34 within the wellhead 12 using the RTHRT 300. The method 400 includes various steps represented by blocks. It should be noted that some or all of the steps of the method 400 may be performed as an automated procedure by an automated system and/or some or all of the steps of the method 400 may be performed manually by an operator. Although the flow chart illustrates the steps in a certain sequence, it should be understood that the steps may be performed in any suitable order and certain steps may be carried out simultaneously, where appropriate. Further, certain steps or portions of the method 400 may be omitted and other steps may be added.

The method 400 may begin by coupling the seal sleeve 302 of the RTHRT 300 to the control line seal sub 306, in step 402. As discussed above, the seal sleeve 302 may be coupled to the control line seal sub 306 via the setting tool 310. In step 404, the control line seal sub 306 may be coupled to the tubing hanger 34, such as via the threaded interface 322.

In step 406, the torque sleeve 304 of the RTHRT 300 may be positioned about the seal sleeve 302 and driven axially until the slots 340 of the torque sleeve 304 engage the drive ring 356 of the lock assembly 350 that is coupled to the tubing hanger 34. To reach the position in which the slots 340 engage the drive ring 356, the shear pins 332 may shear (e.g., break). Furthermore, once the torque sleeve 304 engages the drive ring 356, the torque sleeve 304 may be coupled to the seal sleeve 302, such as via the one or more fasteners 378. In step 408, the body 360 may be threaded onto the control line seal sub 306 and fastened to the seal sleeve 304, such as via the one or more fasteners 368. In some embodiments, once assembled as set forth in steps 402-406, the RTHRT 300 may be utilized to run the tubing hanger 34 into the wellhead 12.

Once in a landed position within the wellhead 12, in step 410, the body 360 may rotate in a first direction to actuate the lock assembly 350 to lock the tubing hanger 34 within the wellhead 12. As discussed above, the threads at the threaded interface 362 between the body 360 and the control line seal sub 306 may be oriented in a first direction, and the threads at the threaded interface 382 between the drive ring 35 and the tubing hanger 34 maybe oriented in a second, opposite direction. Thus, rotation of the body 360 in the first direction to loosen the body 360 from the control line seal sub 306 drives the attached seal sleeve 302 and the attached torque sleeve 304 to rotate in the first direction, and the slots 340 of the torque sleeve 304 contact and drive rotation of the drive ring 356 in the first direction, thereby tightening the drive ring 356 about the tubing hanger 34. Furthermore, rotation of the body 360 in the first direction causes the body 360 and the attached seal sleeve 302 and the torque sleeve 304 to move in a first direction along the axial axis 44 (e.g., to withdraw the RTHRT 300 from the wellhead 12), while simultaneously driving the drive ring 356 in a second, opposite direction along the axial axis 44 to wedge the lock ring 354 radially-outwardly to engage the wellhead 12.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the invention as defined by the following appended claims. For example, while the illustrated embodiments show the tubing hanger 34, it should be understood that the systems and methods may be adapted to run and to set various annular structures, such as various conduits, pipes, and hangers, including casing hangers.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A hanger running tool configured to set a hanger assembly within a wellhead, the hanger running tool comprising:

a rotatable tool body configured to couple to the hanger assembly via a first threaded interface having a first orientation; and an outer sleeve coupled to the rotatable tool body and comprising one or more slots configured to engage a drive ring coupled to the hanger assembly via a second threaded interface having a second orientation opposite the first orientation;

wherein rotation of the rotatable tool body in a first direction is configured to loosen the rotatable tool body from the hanger assembly while causing the one or more slots of the outer sleeve to drive the drive ring in the first direction, thereby tightening the drive ring about the hanger assembly and causing the drive ring to drive a lock ring radially-outwardly to engage a corresponding recess of the wellhead to set the hanger assembly within the wellhead.

2. The hanger running tool of claim 1, wherein the hanger running tool is configured to be separated from the hanger assembly via rotation of the rotatable tool body in the first direction.

3. The hanger running tool of claim 1, comprising a seal sleeve configured to be positioned between the hanger assembly and the outer sleeve along a radial axis of the hanger running tool.

4. The hanger running tool of claim 3, wherein the seal sleeve comprises a first passageway that is configured to support a control line that extends through a second passageway of the hanger assembly.

5. A hanger running system, comprising:

a hanger assembly; and a hanger running tool configured to set the hanger assembly within a wellhead, the hanger running tool comprising:

a rotatable tool body configured to couple to a first portion of the hanger assembly via a first threaded interface having a first orientation; and an outer sleeve configured to couple to the rotatable tool body and to engage a drive ring that is coupled to a second portion of the hanger assembly via a second threaded interface having a second orientation opposite the first orientation and;

a seal sleeve that is configured to be positioned between the hanger assembly and the outer sleeve along a radial axis and to couple to the hanger assembly via an interference fit.

6. The hanger running system of claim 5, wherein the hanger assembly comprises a hanger and a control line seal sub that is configured to support a control line.

7. The hanger running system of claim 5, wherein the seal sleeve comprises a first passageway that is configured to support a control line that extends through a second passageway of a control line seal sub of the hanger assembly.

8. The hanger running system of claim 5, wherein the outer sleeve comprises circumferentially-spaced slots that are configured to engage the drive ring.

9. The hanger running system of claim 8, wherein the outer sleeve comprises a first end portion that is configured to couple to the rotatable tool body via a fastener and a second end portion that comprises the circumferentially-spaced slots that are configured to engage the drive ring.

10. The hanger running system of claim 5, comprising a lock ring, wherein rotation of the rotatable tool body in a rotational direction is configured to drive the outer sleeve and the drive ring to rotate in the rotational direction, to move the rotatable tool body and the outer sleeve in a first axial direction away from the lock ring, and to move the drive ring in a second axial direction toward the drive ring to thereby drive the lock ring radially-outwardly to engage the wellhead to set the hanger assembly within the wellhead.

11. A method of operating a hanger running system to set a hanger assembly within a wellhead, the method comprising:

coupling a rotatable tool body of a hanger running tool to the hanger assembly via a first threaded interface having a first orientation;

positioning an outer sleeve of the hanger running tool to engage a drive ring of a lock assembly, wherein the drive ring is coupled to the hanger assembly via a second threaded interface having a second orientation opposite the first orientation;

coupling the outer sleeve of the hanger running tool to the rotatable tool body of the hanger running tool via a fastener; and rotating the rotatable tool body of the hanger running tool in a rotational direction while the outer sleeve of the hanger running tool is engaged with the drive ring of the lock assembly and while the outer sleeve of the hanger running tool is coupled to the rotatable tool body of the hanger running tool to thereby actuate the lock assembly.

12. The method of claim 11, wherein rotating the rotatable tool body of the hanger running tool in the rotational direction while the outer sleeve of the hanger running tool is engaged with the drive ring of the lock assembly and while the outer sleeve of the hanger running tool is coupled to the rotatable tool body of the hanger running tool causes the drive ring to move in an axial direction relative to a lock ring of the lock assembly to thereby drive the lock ring radially relative to the hanger assembly.

13. The method of claim 12, comprising engaging a corresponding recess in the wellhead with the lock ring to thereby set the hanger assembly within the wellhead.

14. The method of claim 11, wherein positioning the outer sleeve of the hanger running tool to engage the drive ring of the lock assembly comprises driving the outer sleeve axially and without rotation relative to the hanger assembly.

15. The method of claim 11, comprising positioning a seal sleeve of the hanger running tool about the hanger assembly such that the seal sleeve is positioned between the hanger assembly and the outer sleeve along a radial axis.

16. The method of claim 15, wherein positioning the seal sleeve of the hanger running tool about the hanger assembly comprises driving the seal sleeve axially and without rotation relative to the hanger assembly.

17. The method of claim 16, comprising running a control line through a first passageway within the seal sleeve and a second passageway within the hanger assembly.

18. The method of claim 15, wherein coupling the outer sleeve of the hanger running tool to the rotatable tool body of the hanger running tool via the fastener comprises fastening the outer sleeve to the seal sleeve via the fastener and fastening the seal sleeve to the rotatable tool body via an additional fastener.

* * * * *